US005145165A

United States Patent [19]

Sarinopoulos et al.

[11] Patent Number: 5,145,165

[45] Date of Patent: Sep. 8, 1992

[54] DEVICE FOR SEQUENTIALLY STACKING DOCUMENTS IN A PAPER DOCUMENT POCKET

[75] Inventors: George A. Sarinopoulos, Oklahoma City, Okla.; Charles K. Eaton, Lewisville, Tex.

[73] Assignee: BancTec, Inc., Dallas, Tex.

[21] Appl. No.: 513,988

[22] Filed: Apr. 24, 1990

[51] Int. Cl.[5] ..... B65H 31/06

[52] U.S. Cl. ..... 271/177; 271/182; 271/220

[58] Field of Search ..... 271/177, 182, 220, 224

[56] References Cited

U.S. PATENT DOCUMENTS

| | | | |
|---|---|---|---|
| 4,223,885 | 9/1980 | Templeton | 271/220 |
| 4,270,747 | 6/1981 | Templeton . | |
| 4,573,677 | 3/1986 | Cuir . | |
| 4,576,371 | 3/1986 | Takahashi et al. . | |
| 4,600,186 | 7/1986 | von Hein et al. . | |
| 4,662,626 | 5/1987 | Shores et al. . | |
| 4,667,953 | 5/1987 | Hirakawa et al. . | |
| 4,718,660 | 1/1988 | Daboub . | |
| 4,822,024 | 4/1989 | Takahashi . | |
| 4,828,246 | 5/1989 | Wegel et al. . | |

*Primary Examiner*—Richard A. Schacher

*Attorney, Agent, or Firm*—Kenneth R. Glaser

[57] ABSTRACT

A pocket for receiving and stacking sorted documents from a high-speed reader sorter includes an anti-jamming device for engaging the documents in the pocket to urge the documents into a stacked configuration according to the sequence in which the documents enter the pocket. The device includes a casing having a plurality of flexible elements projecting therefrom, such that the elements extend transversely with respect to the path of the incoming documents. A document entering the pocket will bend at least some of the flexible elements along the path of the incoming document. The flexible elements deflect the previously pocketed documents out of the path of the incoming documents, to allow the incoming document to enter the pocket unimpeded. The flexible elements are held in discrete bundles by mounting the elements in trapezoidal-shaped cavities within the casing. The flexible elements have sufficient stiffness to resist bunching and tangling at the free ends of the flexible elements, such that the integrity of the individual bundles of flexible elements is maintained and the flexible elements exert a consistent biasing force on the documents to inhibit jamming and to urge the documents sequentially into the stacked configuration.

17 Claims, 2 Drawing Sheets

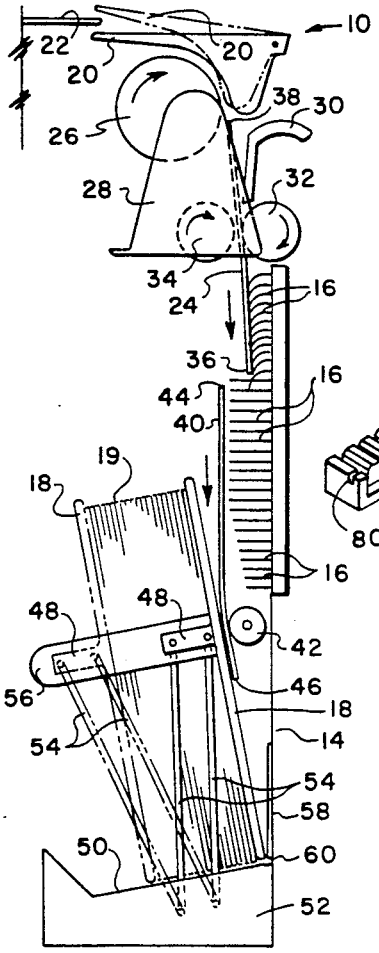
FIG. 1
FIG. 2B
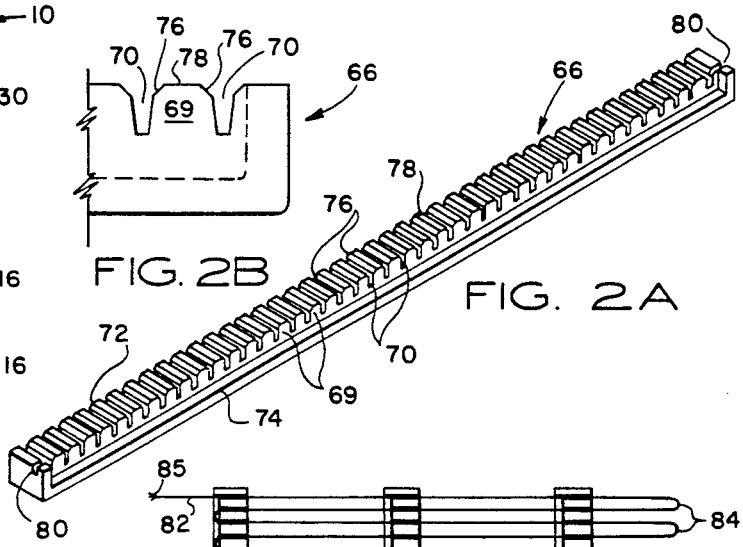
FIG. 2A
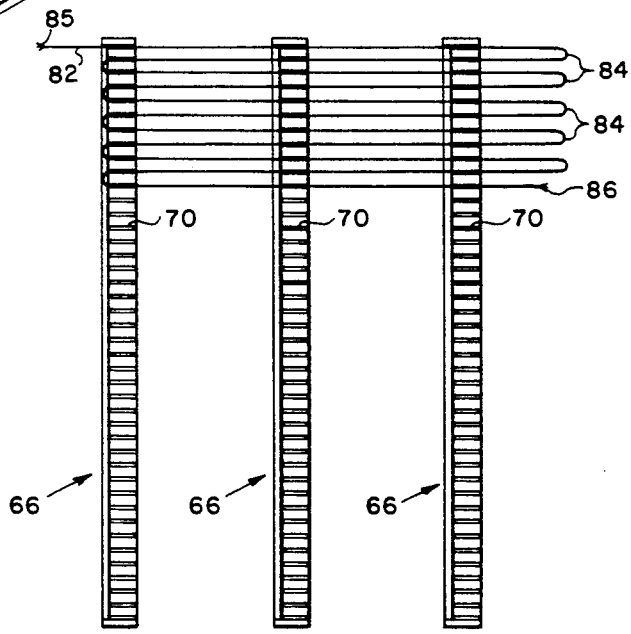
FIG. 3
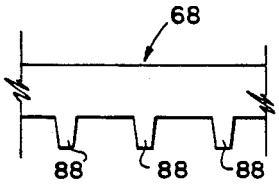
FIG. 4B
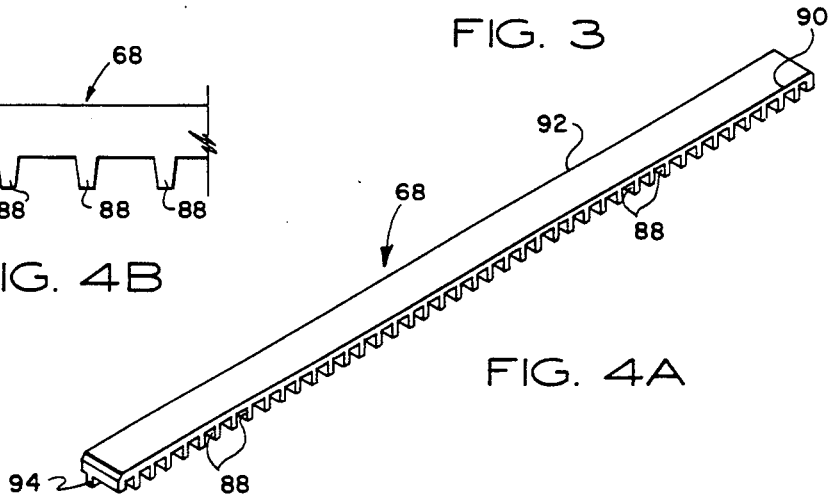
FIG. 4A

DEVICE FOR SEQUENTIALLY STACKING DOCUMENTS IN A PAPER DOCUMENT POCKET

FIELD OF THE INVENTION

This invention relates generally to document reader sorters and in particular to a device for sequentially stacking documents in a pocket in which sorted documents are received.

BACKGROUND OF THE INVENTION

Machines for reading and sorting paper documents are used in a variety of applications. One such application is in the banking industry in which encoded documents, such as checks and bank deposit slips, are processed by a high-speed reader sorter machine in which the documents are read, sorted (e.g., by bank routing or account numbers) and then stacked in appropriate pockets in the sequences in which the documents enter the corresponding pockets. During high-speed operation, paper jams and foldovers in the pockets may occur because of differing sizes, thicknesses and weights among the documents being received in the pockets. A common cause of paper jams in the pockets is a collision between the leading edge of an incoming document and the trailing edge of a previously pocketed document.

DESCRIPTION OF THE PRIOR ART

Prior art reader sorters have used springs, air jets, augers, brushes and the like in an attempt to inhibit jamming in a document pocket, as disclosed in U.S. Pat. Nos. 4,270,747; 4,576,371; 4,600,186; 4,662,626; 4,667,953; 4,718,660; 4,822,024; and 4,828,246. U.S. Pat. No. 4,662,626 discloses a brush member, which is positioned in the pocket of a document reader sorter, such that the flexible elements thereof extend transversely relative to the direction of travel of the incoming documents. At least some of the flexible elements are bent downwardly by the leading edge of each incoming document. Each incoming document is "cupped" to enhance the stiffness thereof. As each document continues its downward movement in the pocket, the flexible elements will urge the document toward a stack of previously pocketed documents and out of the path of the next incoming document, so that the incoming document can slip behind the previously pocketed documents to prevent the leading edge of the incoming document from colliding with the other documents in the pocket and maintain a predetermined sequence in the document stack.

One problem which has been encountered with such prior art brush members is that at least some of the flexible elements tend to become bunched at the ends thereof due to the repeated deflections of the flexible elements, thereby requiring periodic "combing" to separate the elements. Bunching of the flexible elements results in an inconsistent biasing force on the documents, which increases the likelihood of jamming and may result in the documents being stacked out of sequence. Fabrication of such prior art brush members has also been a problem. Typically, the flexible elements are grouped into discrete bundles and each bundle is tied together by a cord or the like and attached to a casing by inserting a portion of the bundle into a corresponding opening in the casing and securing the cord to the casing. Because the bundles must be hand-tied and secured one at a time to the casing, the fabrication process is inefficient and time-consuming.

OBJECTS OF THE INVENTION

It is therefore the principal object of the present invention to provide an improved device for stacking documents in a paper document pocket of a document reader sorter.

Another object of the invention is to provide an improved paper document pocket for receiving and stacking sorted documents in a high-speed reader sorter.

Yet another object of the invention is to provide an improved method of assembling a device for sequentially stacking documents in a paper document pocket.

A further object of the invention is to provide a device for exerting a consistent biasing force on documents entering a paper document pocket to prevent collisions between documents and to urge the documents into a stack according to the sequence in which the documents enter the pocket.

SUMMARY OF THE INVENTION

These and other objects are accomplished in accordance with the present invention wherein a paper document pocket for receiving and stacking sorted documents includes a device for sequentially stacking the documents and inhibiting jamming in the pocket. The device is comprised of an elongated base member having a plurality of ridges thereon and a plurality of recesses between adjacent ones of the ridges, and an elongated cover member having a plurality of teeth at spaced intervals thereon in mating engagement with the respective recesses to define a casing. A plurality of discrete bundles of flexible elements project from the casing.

In operation the device is positioned in the pocket, such that the bundles of flexible elements extend transversely with respect to the path of the incoming documents. When a document enters the pocket, the leading edge thereof will bend at least some of the flexible elements in the direction of movement of the incoming document. As the document continues its downward movement in the pocket, the flexible elements will exert a biasing force on the document to deflect it toward a stack of previously pocketed documents and out of the path of the next incoming document, thereby substantially preventing jamming in the pocket, particularly during high-speed operation.

In accordance with one feature of the invention, each of the ridges is tapered along opposite sides thereof to define complementary tapered recesses between the ridges. The teeth are also tapered for penetrating at least partially into the respective recesses to define respective trapezoidal-shaped cavities in the bottom portions of the respective recesses. Respective top portions of the ridges are beveled to facilitate the insertion of the teeth into the respective recesses. Respective first portions of the bundles of flexible elements are retained within the respective cavities by the mating engagement between the teeth and the respective recesses, such that respective second portions of the bundles project from the respective cavities. This configuration provides the flexible elements with sufficient stiffness to resist bunching among the flexible elements at the free ends thereof, so that the flexible elements will apply a consistent biasing force to the incoming documents.

In accordance with another feature of the invention, the device is assembled by positioning a plurality of base members in substantially parallel relationship so that the corresponding recesses thereof are substantially aligned and lacing a multistrand cord through the aligned recesses in a reciprocating manner to define a series of loops extending back and forth through the recesses. After the cord has been laced through all of the recesses, the respective cover members are placed on top of the base members, so that the teeth of the respective cover members are in mating engagement with the recesses of the respective base members, thereby defining the respective casings. The loops are then cut to form the discrete bundles of flexible elements, which project from respective front sides of the casings. An adhesive material is applied on respective back sides of the casings to secure the cover members to the corresponding base member and to retain the bundles of flexible elements within the corresponding recesses. The assembly process described above facilitates mass production of the device by eliminating the laborious process of tying the flexible elements together and then securing each group of elements separately to the casing.

BRIEF DESCRIPTION OF THE DRAWINGS

Other objects and advantages of the invention will be apparent from the detailed description and claims when read in conjunction with the accompanying drawings, wherein:

FIG. 1 is a side elevation view of a paper document pocket for receiving and stacking sorted documents, according to the present invention;

FIGS. 2A–5 are various views, illustrating the process of assembling a device for inhibiting jamming in a paper document pocket, according to the present invention;

DETAILED DESCRIPTION OF THE PREFERRED EMBODIMENT

Figure 5:
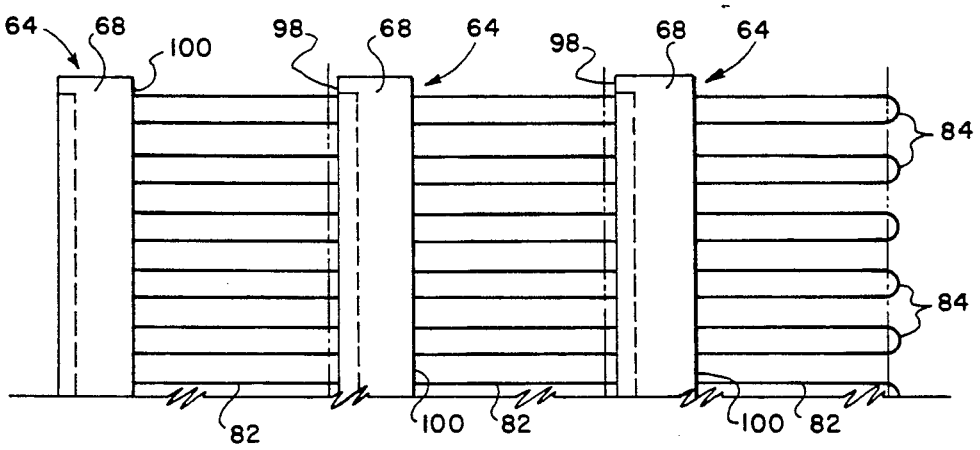

In the description which follows, like parts are marked throughout the specification and drawings, respectively. The drawings are not necessarily to scale and in some instances, proportions have been exaggerated in order to more clearly depict certain features of the invention.

Referring to FIG. 1, a paper document pocket 10 for receiving and stacking sorted documents, after the documents have been processed in a high-speed reader sorter, includes a housing 14 having a plurality of flexible elements 16 projecting from one side of housing 14 and a flap member 18 for supporting the pocketed documents in a stacked column 19. A solenoid-activated gate 20 is pivotally mounted in a top portion of housing 14 for directing a document 22 into housing 14 when gate 20 is in a raised position, as indicated by the dashed lines. Another document 24 is shown entering housing 14, where it is engaged by a drive capstan 26, which directs document 24 into a cupping assembly 28, having a lead edge guide 30, an idler roller 32 and a driven pinch roller 34. Guide 30 engages opposite sides of document 24 as the central portion of document 24 is received between idler roller 32 and pinch roller 34, to bend or cup document 24 along its major axis, thereby substantially increasing the stiffness thereof, so that document 24 will follow a relatively straight path as it enters housing 14. Leading edge 36 of incoming document 24 bends at least some of the flexible elements 16 downwardly in the direction of movement of incoming document 24. Document 24 is maintained in a cupped configuration until trailing edge 38 thereof clears cupping assembly 28.

A previously pocketed document 40 is shown below incoming document 24 in housing 14. A low inertia roller 42, which is located below flexible elements 16, urges document 40 downwardly toward the bottom of pocket 10. The flexible elements 16 which are yet to be deflected by incoming document 24 urge document 40 into the stacked column 19 to prevent leading edge 36 of incoming document 24 from colliding with trailing edge 44 of document 40, to allow incoming document 24 to slip behind document 40, so that the documents are stacked against flap 18 in the same sequence in which the documents enter housing 14. The lowermost flexible elements 16, adjacent to roller 42, are shorter than the other flexible elements 16, in order to guide the leading edge 46 of document 40 toward roller 42, such that the inertia of document 40 will carry document 40 to the bottom of the pocket 10.

Flap 18 is attached to a rearwardly extending arm 48, which is oriented substantially parallel to an angled surface 50 on a bottom tray 52. A pair of linkage arms 54 are coupled between arm 48 and bottom tray 52. An angled slot 56 allows flap 18 and arm 48 to move axially, so that as pocket 10 is filled with documents, the weight of stacked column 19 resting at an angle against flap 18 will move flap 18 and arm 48 away from flexible elements 16 to make room for the next documents in sequence.

Attached to a side of housing 14, adjacent to bottom tray 52, is a paper clutch 58, which is made of a fabric with fibers biased downwardly for preventing document 40 from bouncing upward as it strikes flat surface 60, thereby allowing the document 40 to slide downwardly on angled surface 50 into stacked column 19 Angled surface 50 preferably includes upwardly extending ribs (not shown) to reduce friction on document 40 as it slides down angled surface 50.

In operation, pocket 10 is used to stack paper documents of various sizes and weights in columns 19 in the sequence in which the documents enter pocket housing 14. In a typical reader sorter machine used in the banking industry, documents 22 are placed in a feed hopper and individually fed into a transport of the reader sorter. After entering the transport, the documents 22 go through an alignment device and then enter a reader area. There documents 22 are read and a microprocessor tracks the documents 22 as they make their way along the document transport. The transport and the various reader sorter equipment are not shown in the drawings. As each document 22 nears its designated pocket 10, a microprocessor activates a solenoid, which operates the corresponding gate 20 to route the document 22 into the corresponding pocket housing 14.

Figure 8:
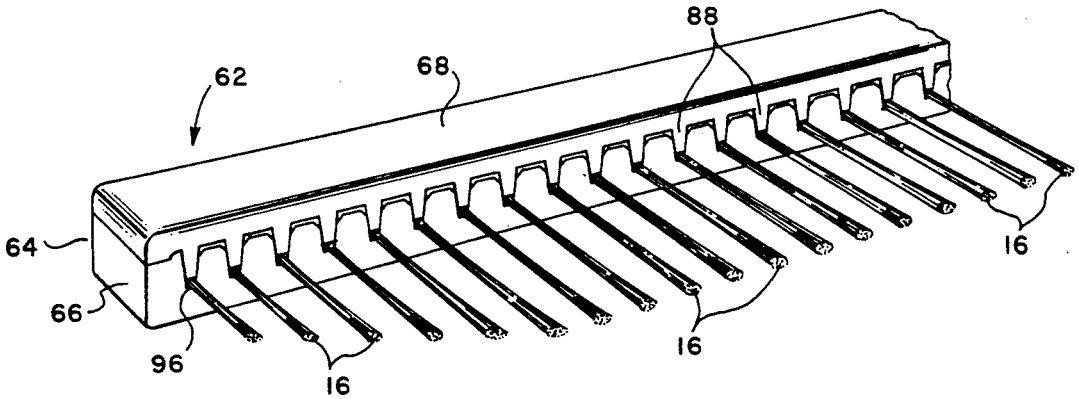
FIG. 8 is a perspective view of the assembled device.

Referring to FIG. 8, in accordance with one feature of the invention, a device 62 is provided for retaining flexible elements 16 in a predetermined configuration, such that elements 16 will exert a consistent biasing force on the documents in the pocket. Device 62 is comprised of a two-piece casing 64, from which discrete bundles of flexible elements 16 project. Device 62 is mounted within a paper document pocket, such that casing 64 is oriented along the direction of travel of the documents entering the pocket and the discrete bundles of flexible elements 16 extend transversely with respect to the path of the incoming documents. Casing 64 is comprised of a base member 66 and a cover member 68, which are coupled together in the manner described hereinafter.

Referring to FIGS. 2A–7, the process of assembling device 62 is depicted. Referring specifically to FIGS. 2A and 2B, base member 66 is comprised of a substantially rectangular, elongated piece of plastic material, a top portion of which has a plurality of spaced-apart ridges 69, to define a corresponding plurality of recesses 70. Ridges 69 and recesses 70 extend transversely with respect to a major axis of base member 66, beginning at front edge 72 thereof and terminating prior to back edge 74. Opposite sides of each ridge 69 are tapered upwardly from the top portion of base member 66, to define substantially trapezoidal-shaped recesses 70 between the ridges 69. Portions of each ridge 69 are beveled, as indicated at 76, to define a relatively flat apex 78. A locator notch 80 is disposed at each end of base member 66.

Referring to FIG. 3, the device can be assembled in multiple units by positioning a plurality of base members 66 in substantially parallel relationship, such that the corresponding recesses 70 of base members 66 are substantially aligned. A multi-strand cord 82 is laced in a reciprocating manner back and forth through the aligned recesses 70 to form a series of loops 84. Only three base members 66 are depicted in FIG. 3, but one skilled in the art will appreciate that any reasonable number of base members 66 can be arranged in parallel relationship, as desired. One end 85 of cord 82 may be secured to one of the base members 66 (e.g., the base member 66 on the left in FIG. 3) and an opposite end 86 thereof will be laced through the aligned recesses 70 in a reciprocating manner to define loops 84.

Referring to FIGS. 4A and 4B, cover member 68 is comprised of an elongated, substantially rectangular piece of plastic having a plurality of teeth 88 at spaced intervals on a bottom portion thereof for mating with the respective recesses 70 in a corresponding base member 66. Each tooth 88 extends transversely with respect to a major axis of cover member 68, beginning at a front edge 90 thereof and terminating prior to a back edge 92 thereof. Teeth 88 are tapered downwardly from the bottom portion of cover member 68 to define a trapezoidal shape which is complementary with the trapezoidal-shaped recesses 70. Cover member 68 further includes a locator tooth 94 at each end thereof for mating with a corresponding locator notch 80 at each end of base member 66 when cover member 68 is positioned on top of base member 66.

Figure 6:
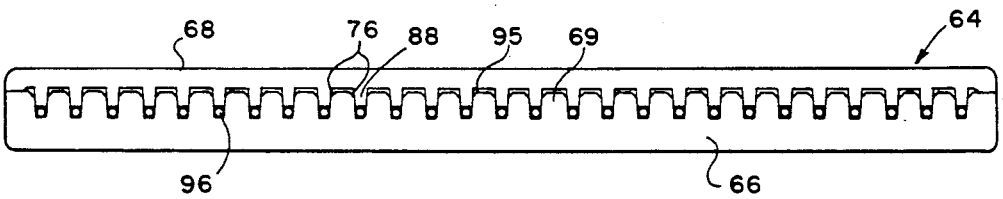
FIG. 6 is a front elevation view of the assembled device.

Referring to FIGS. 5 and 6, a cover member 68 is placed on top of each base member 66 after all of the recesses 70 have been laced with cord 82. When so assembled, teeth 88 will mate with the respective recesses 70 and ridges 69 will mate with respective spaces 95 between teeth 88, as best seen in FIG. 6, to sandwich respective first portions of cord 82 between cover members 68 and the corresponding base members 66 and retain the respective first portions of cord 82 securely within the corresponding recesses 70. The beveled portions 76 of ridges 69 facilitate the insertion of teeth 88 into the respective recesses 70. The complementary trapezoidal shapes of recesses 70 and teeth 88 prevent teeth 88 from extending all the way to the bottom of the respective recesses 70, such that a trapezoidal-shaped cavity 96 is defined at the bottom of each recess 70 for receiving the respective first portions of cord 82. Respective second portions of cord 82 extend between the assembled casings 64.

Figure 7:
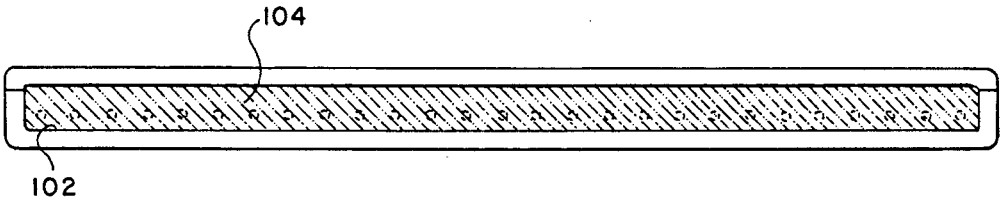
FIG. 7 is a rear elevation view of the assembled device.

After the respective casings 64 are assembled, the loops 84 are cut, along respective back sides 98 of the casings 64, to define a plurality of discrete bundles of flexible elements 16 projecting from a front side 100 of each casing 64. The broken lines in FIG. 5 indicate the approximate positions at which loops 84 are cut. Each of the strands comprising cord 82 defines an individual flexible element 16. Referring also to FIG. 7, the assembled casing 64 has a recessed region 102, adjacent to back side 98 thereof, for receiving an adhesive material 104, to secure cover member 68 and base member 66 together, and to further secure the bundles of flexible elements 16 within the respective cavities 96.

Referring again to FIG. 8, the assembled device 62 has a plurality of flexible elements 16 grouped in discrete bundles, projecting from the respective cavities 96. The clamping pressure exerted by teeth 88 on the flexible elements 16 causes flexible elements 16 to substantially conform to the shape of the corresponding cavities 96, thereby maintaining the integrity of each bundle, so that flexible elements 16 have a sufficient stiffness to resist bunching at the free ends thereof. When flexible elements 16 become bunched or entangled, the documents will not be deflected in a consistent manner by flexible elements 16, which may cause collisions between documents and stacking of the documents in an improper sequence.

Various embodiments of the invention have now been described in detail. Since it is obvious that many changes in and additions to the above-described preferred embodiment may be made without departing from the nature, spirit and scope of the invention, the invention is not to be limited to said details, except as set forth in the appended claims.

What is claimed is:

1. A device for sequentially stacking documents in a document sorter, said document sorter having at least one document receiving pocket, said device comprising:

an elongated base member having a plurality of ridges at spaced intervals thereon to define a plurality of recesses between adjacent ridges, said ridges and said recesses extending transversely with respect to a major axis of said base member;

an elongated cover member having a plurality of teeth at spaced intervals thereon in mating engagement with the respective recesses to define a casing; and a plurality of discrete bundles of flexible elements, respective first portions of which are received within the respective recesses and respective second portions of which project outwardly from said casing, said device being positionable in said at least one document receiving pocket such that said discrete bundles of flexible elements are engageable with the documents to urge the document into a stacked configuration in said at least one document receiving pocket according to the sequence in which the document enter said at least one document receiving pocket.

2. The device of claim 1 wherein said device is positionable within said at least one document receiving pocket such that the discrete bundles of flexible elements extend transversely with respect to a direction in which documents enter said at least one document receiving pocket, said discrete bundles of flexible elements being bent in said direction by incoming documents for allowing each document to enter said at least one document receiving pocket behind the previously pocketed documents.

3. The device of claim 1 wherein opposite sides of each ridge are tapered for defining respective complementary tapered recesses, each of said teeth being tapered for being inserted at least partially into the corresponding recess to attain the first portion of the corresponding bundle of flexible elements within the corresponding recess.

4. The device of claim 3 wherein the mating engagement between the teeth and the respective recesses defines respective trapezoidal-shaped cavities in respective bottom portions of said recesses for receiving the respective first portions of the bundles of flexible elements, the respective second portions of said bundles of flexible elements projecting outwardly from the respective cavities.

5. The device of claim 4 wherein respective top portions of the ridges are beveled for urging the teeth into the respective recesses.

6. The device of claim 1 wherein said cover member includes a locator tooth at each end thereof and said base member includes a notch at each end thereof for receiving a corresponding locator tooth to position said cover member with respect to said base member.

7. The device of claim 1 wherein said ridges and said recesses extend from a front edge of said base member toward a back edge thereof and terminate prior to the back edge of said base member, said teeth extending from a front edge of said cover member toward a back edge thereof and terminating prior to the back edge of said cover member, the connection between said cover member and said base member defining a recessed region adjacent to the respective back edges of said cover member and said base member for receiving an adhesive material, whereby said cover member and base member are fastened together.

8. A document sorter, comprising:

at least one document receiving pocket;

a housing having a top opening therein for allowing documents to enter said at least one document receiving pocket;

means for transporting documents through said top opening into said at least one document receiving pocket;

urging means for urging documents entering said at least one document receiving pocket, said urging means including an elongated base member having a plurality of ridges at spaced intervals thereon to define a plurality of recesses between adjacent ridges, an elongated cover member having a plurality of teeth at spaced intervals thereon, said teeth being in mating engagement with the respective recesses to define a casing, said urging means further including a plurality of discrete bundles of flexible elements projecting from the casing, said bundles of flexible elements extending transversely with respect to a direction along which the documents travel as the enter said at least one document receiving pocket for urging said documents into the stacked configuration according to the sequence in which the documents enter said at least one document receiving pocket; and, means for supporting the previously pocketed documents in the stacked configuration within said at least one document receiving pocket.

9. The document sorter of claim 8 wherein at least some of said flexible elements are bent in said direction by incoming documents such that said incoming documents enter said at least one document receiving pocket behind the previously pocketed documents.

10. The document sorter of claim 8 wherein opposite sides of each ridge are tapered for defining respective complementary tapered recesses, each of said teeth being tapered for being inserted at least partially into the corresponding recess for retaining a first portion of the corresponding bundle of flexible elements within the corresponding recess.

11. The document sorter of claim 10 wherein the mating engagement between the teeth and the respective recesses defines respective trapezoidal-shaped cavities in respective bottom portions of said recesses for receiving the respective first potions of the bundles of flexible elements, respective second portions of said bundles projecting outwardly form the respective cavities.

12. The document sorter of claim 11 wherein respective top portions of the ridges are beveled for urging the teeth into the respective recesses.

13. The document sorter of claim 8 wherein said cover member includes a locator tooth at each end thereof and said base member includes a notch at each end thereof for receiving a corresponding locator tooth to position said cover member with respect to said base member.

14. The document sorter of claim 8 wherein said ridges and said recesses extend from a front edge of said base member toward a back edge thereof and terminate prior to the back edge of said base member, said teeth extending from a front edge of said cover member toward a back edge thereof and terminating prior to the back edge of said cover member, the connection between said cover member and said base member defining a recessed region adjacent to the respective back edges of said cover member and said base member for receiving an adhesive material, whereby said cover member and base member are fastened together.

15. In combination:

(a) a document sorter having at least one document receiving pocket; and (b) a device disposed within said at least one document receiving pocket for sequentially stacking document transported to said sorter within said pocket, said device comprising:

(i) an elongated base member having a plurality of ridges at spaced intervals thereon to define a plurality of recesses between adjacent ridges, each of said ridges and recesses extending transversely with respect to a major axis of said base member form a front edge thereof toward a back edge thereof and terminating prior to said back edge, opposed sides of each ridge being tapered to define complementary tapered recesses therebetween;

(ii) an elongated cover member having a plurality of teeth extending transversely with respect to a major axis thereof from a front edge of said cover member toward a back edge thereof and terminating prior to said back edge of the cover member, said teeth being tapered and being in mating engagement with the respective recesses such that said teeth penetrate at least partially into the respective recesses to define respective trapezoidal-shaped cavities in the respective recesses; and (iii) a plurality of discrete bundles of flexible elements for urging said transported documents into a stacked configuration in said pocket, respective first portions of said bundles of flexible elements being received within the respective cavities, and respective second portions of said bundles of flexible elements projecting outwardly form the respective cavities on the front portion of said base member, said respective first portions conforming to the shape of the respective cavities to maintaining the flexible elements of each bundle separate from the flexible elements of the other bundles, the engagement between the cover member and base member defining a recessed region adjacent the respective back portions of the cover member and base member, said recessed region being adapted to receive an adhesive material for securing the cover member and base member together and for retaining the bundles of flexible elements between the cover member and base member.

16. A device for sequentially stacking documents in a document sorter, said document sorter having at least one document receiving pocket, said device comprising:

a base member having a plurality of recesses at spaced intervals;

a cover member having a plurality of teeth at spaced intervals, said teeth being in mating engagement with the respective recesses such that the base member and cover member cooperate to define a casing; and, a plurality of flexible members, respective first portions of said flexible members being received within the respective recesses and respective second portions of the flexible members projection outwardly from said casing, said device being positionable in said at least one document receiving pocket such that the flexible member is engageable with the documents to urge the documents into a stacked configuration in said at leas one document receiving pocket according to the sequence in which the documents enter said at least one document receiving pocket.

17. In combination:

(a) a document sorter having at least one document receiving pocket; and (b) a device disposed within said pocket for sequentially stacking documents within said pocket, said device comprising:

(i) a base member having a plurality of recesses at spaced intervals;

(ii) a cover member having a plurality of teeth at spaced intervals, said teeth being in mating engagement with the respective recesses such that the base member and cover member cooperate to define a casing; and, (iii) a plurality of flexible members, respective first portions of said flexible members being received within the respective recesses and respective second portions of the flexible members projecting outwardly from said casing, said device being disposed in said at least one document receiving pocket such that the flexible members are engageable with the documents to urge the documents into a stacked configuration in said at least one document receiving pocket according to the sequence in which the documents enter said at least one document receiving pocket.

* * * * *

UNITED STATES PATENT AND TRADEMARK OFFICE

CERTIFICATE OF CORRECTION

PATENT NO. : 5,145,165

DATED : September 8, 1992

INVENTOR(S) : George A. Sarinopoulos and Charles K. Eaton

It is certified that error appears in the above-identified patent and that said Letters Patent is hereby corrected as shown below:

Column 6, line 59, second occurrence, "document" should read "documents".

Column 6, line 62, "document" should read "documents".

Column 7, line 10, "attain" should read "retain".

Column 7, line 64, "the" should read "they".

Column 8, line 20, "potions" should read "portions".

Column 8, line 22, "form" should read "from".

Column 8, line 50, "document" should read "documents".

Column 8, line 57, "form" should read "from".

Column 9, line 16, "maintaining" should read "maintain".

Column 10, line 4, "projection" should read "projecting".

Column 10, line 9, "leas" should read "least".

Signed and Sealed this

Seventh Day of September, 1993

Bruce Lehman

*Attest:*

BRUCE LEHMAN

*Attesting Officer*

*Commissioner of Patents and Trademarks*